US005523771A

United States Patent [19]

Kim

[11] Patent Number: 5,523,771

[45] Date of Patent: Jun. 4, 1996

[54] METHOD FOR DRIVING A PLASMA DISPLAY PANEL

[75] Inventor: Sang-cheol Kim, Suwon, Rep. of Korea

[73] Assignee: Samsung Display Devices Co., Ltd., Kyungki-do, Rep. of Korea

[21] Appl. No.: 198,270

[22] Filed: Feb. 18, 1994

[30] Foreign Application Priority Data

Aug. 23, 1993 [KR] Rep. of Korea ..... 93-16346

[51] Int. Cl.[6] ..... G09G 3/28

[52] U.S. Cl. ..... 345/66; 345/60; 345/68

[58] Field of Search ..... 345/60, 62, 66, 345/67, 68, 71

[56] References Cited

U.S. PATENT DOCUMENTS 4,100,535 7/1978 Bitzer et al. ..... 345/68

4,128,901 12/1978 Miller ..... 345/68

4,591,847 5/1986 Criscimagna et al. ..... 345/68

*Primary Examiner*—Richard Hjerpe

*Assistant Examiner*—Kent Chang

*Attorney, Agent, or Firm*—Leydig, Voit & Mayer

[57] ABSTRACT

A method for driving a plasma display panel in which a plurality of discharging cells each being comprised of an anode, a sustaining anode, a triggering electrode and a cathode is arranged in a form of matrix, comprises trigger discharging step, trigger discharge extinguishing step, primary discharge step, discharge sustaining step and discharge extinguishing step. Accordingly, the discharging can be prevented in case of no data given.

8 Claims, 4 Drawing Sheets

METHOD FOR DRIVING A PLASMA DISPLAY PANEL

BACKGROUND OF THE INVENTION

The present invention relates to a method for driving a plasma display panel, and more particularly to a method for driving a direct current memory type plasma display panel.

In general, the method for driving a direct current memory type plasma display panel (PDP) is classified into two groups: supplementary discharging using a supplementary anode for easier primary discharge and trigger discharging using a trigger electrode.

FIG. 1 shows the structure of the conventional direct current (DC) memory type PDP.

Referring to FIG. 1, the PDP has two plates, i.e., an upper plate 10 and an lower plate 20. Anodes 11 are arranged as stripes on tipper plate 10, and a trigger electrode 21 is formed oil the whole surface of lower plate 20. Trigger electrode 21 is covered with a dielectric material 22 on which a partition wall 23 is constructed in the shape of a lattice. Partition wall 23 is accompanied with striped cathodes 24 on its right side and has striped sustaining anodes 25 on its left side.

FIGS. 2A–2D show waveforms detected at each electrode, for driving, the conventional DC-memory type PDP.

FIG. 2A shows the data loaded on an anode, FIG. 2B shows the pulse applied at the sustaining anode, FIG. 2C shows the pulse applied at the trigger electrode, and FIG. 2D shows the scan pulse applied at the cathode.

Tile method for driving the PDP is hereinafter described with reference to FIG. 1 and FIGS. 2A–2D.

1) When the trigger signal turns on, i.e., when the triggering voltage is about −500 V and the voltage applied at an anode is about +100 V, the discharging occurs, so that the positive charges accumulate on the dielectric layer.

2) When a first cathode initially turns on. i.e. when a first cathode is applied with about −180 V, the positive charges accumulated on the dielectric layer around first cathode begin to discharge. As such, the triggering discharge occurs.

3) If the first cathode turns on again and is supplied with data, the primary discharge is induced. That is, the triggering discharge in step 2) facilitates the primary discharge.

4) After the primary discharge of step 3) takes place, the discharge can be sustained by means of the sustaining voltage applied at the sustaining anode and the voltage applied at the cathode.

5) When the voltage applied at first cathode reaches the maximum voltage level, the discharge stops. This step is for suspending the discharging operation.

In such cases, since the on-time is short and the data voltage is not provided during a triggering discharge duration, the triggering discharge is insufficient for facilitating the primary discharge. However, if the triggering discharge is insufficient, although the data is not supplied during the primary discharging period, the triggering discharge is induced so that the sustaining discharge can be maintained.

SUMMARY OF THE INVENTION

It is an object of the present invention to provide a method for driving a plasma display panel for facilitating a primary discharge by supplying a sufficient triggering discharge voltage.

It is another object of the present invention to provide a method for driving a plasma display panel for preventing the malfunction of discharging and the following sustaining discharge, even though data is not supplied in the main scan period when the triggering discharge is insufficient.

To accomplish the above objects, the present invention provides a method for driving a plasma display panel, in which a plurality of discharging cells each of which is comprised of an anode, a sustaining anode, a triggering electrode and having a cathode arranged in matrix form, the method comprising: a trigger setting step for generating a trigger discharge due to the voltage difference between the trigger pulse signal applied with the trigger electrode and the data pulse signal applied with the anode, to thereby accumulate positive charges on the dielectric material layer on the trigger electrode; a trigger discharging step for producing a discharge by means of the first trigger discharge pulse applied with the first cathode and the data pulse signal applied at the anode, and simultaneously discharging the positive charges accumulated on the dielectric material layer around the first cathode so as to result in a sufficient triggering discharge, and extinguishing the positive charges amassed on the dielectric material layer: a primary discharging step by which a discharge does not occur if no data is applied at the anode when the first cathode turns on again after the completion of the trigger discharging step, and creating a primary discharge in the event of data being applied at the anode; a discharge sustaining step for sustaining the discharge state by means of the difference between the voltage of sustaining pulse applied at the sustaining anode and the voltage applied at the cathode, after the primary discharge step: and a discharge extinguishing step for, upon completion of the discharge sustaining step, removing the sustaining discharge from the sustaining step by lowering below the sustaining voltage the difference between the voltage of pulse applied at the cathode and the voltage applied at the sustaining anode.

Namely, in the driving method according to the present invention, the triggering discharge is completely executed, and the discharge is prevented from being generated when no data exists. For this end, a pulse for discharging the scan pulse is applied at the anode while the triggering pulse is applied at the cathode. Therefore, a complete discharge can be achieved.

BRIEF DESCRIPTION OF THE DRAWINGS

The above object and other advantages of the present invention will become more apparent by describing in detail a preferred embodiment of the present invention with reference to the attached drawings in which.

DETAILED DESCRIPTION OF THE INVENTION

Hereinafter, a method for driving a plasma display panel (PDP) according to the present invention will be described with reference to the attached drawings.

FIGS. 3A–3D are waveforms of pulses applied to the electrodes for the driving of the PDP according to the present invention.

Figure 1:
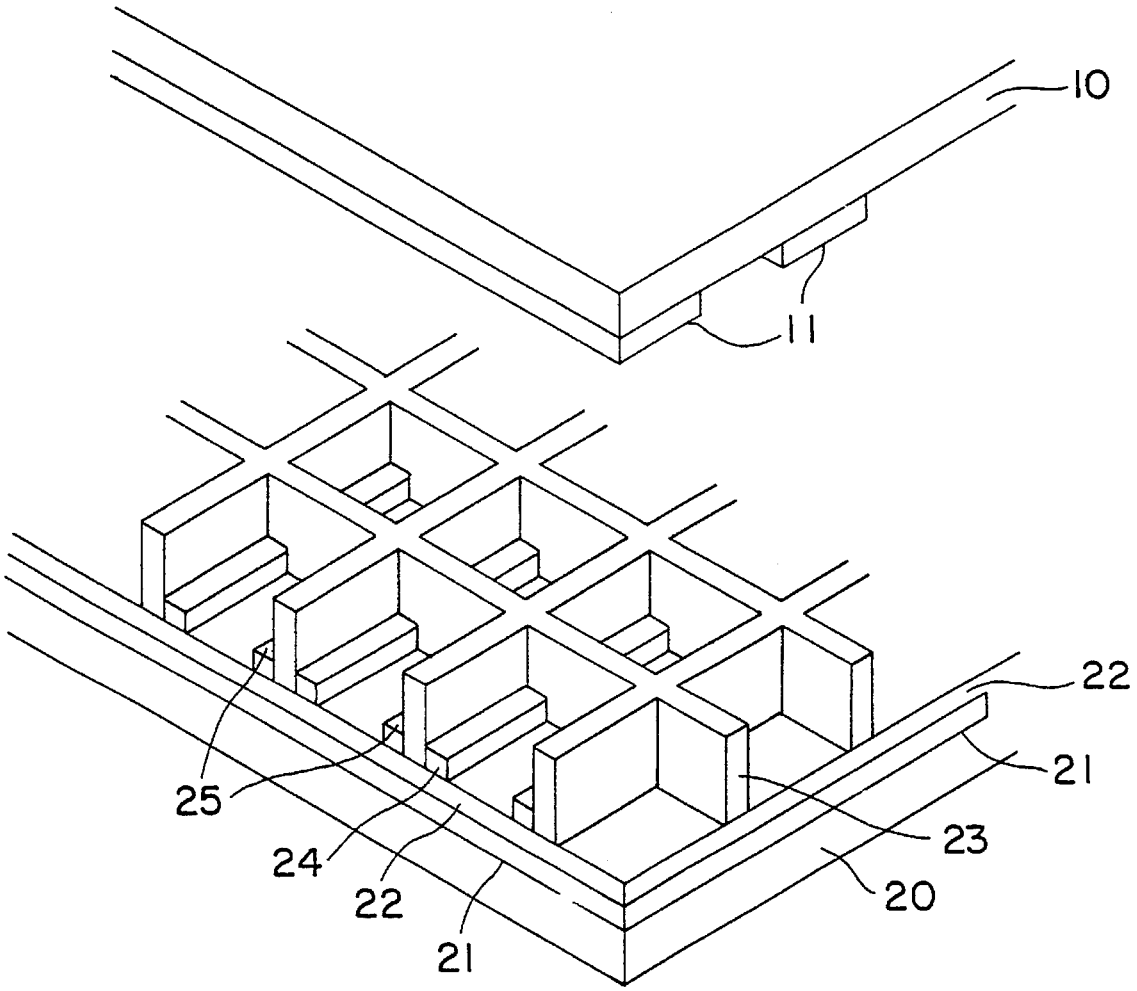
FIG. 1 shows the structure of a direct current memory type plasma display panel (PDP) to which the driving methods for the direct current memory type PDP according to the present invention and the prior arts are applied.
Figures 2A, 2B, 2C, 2D:
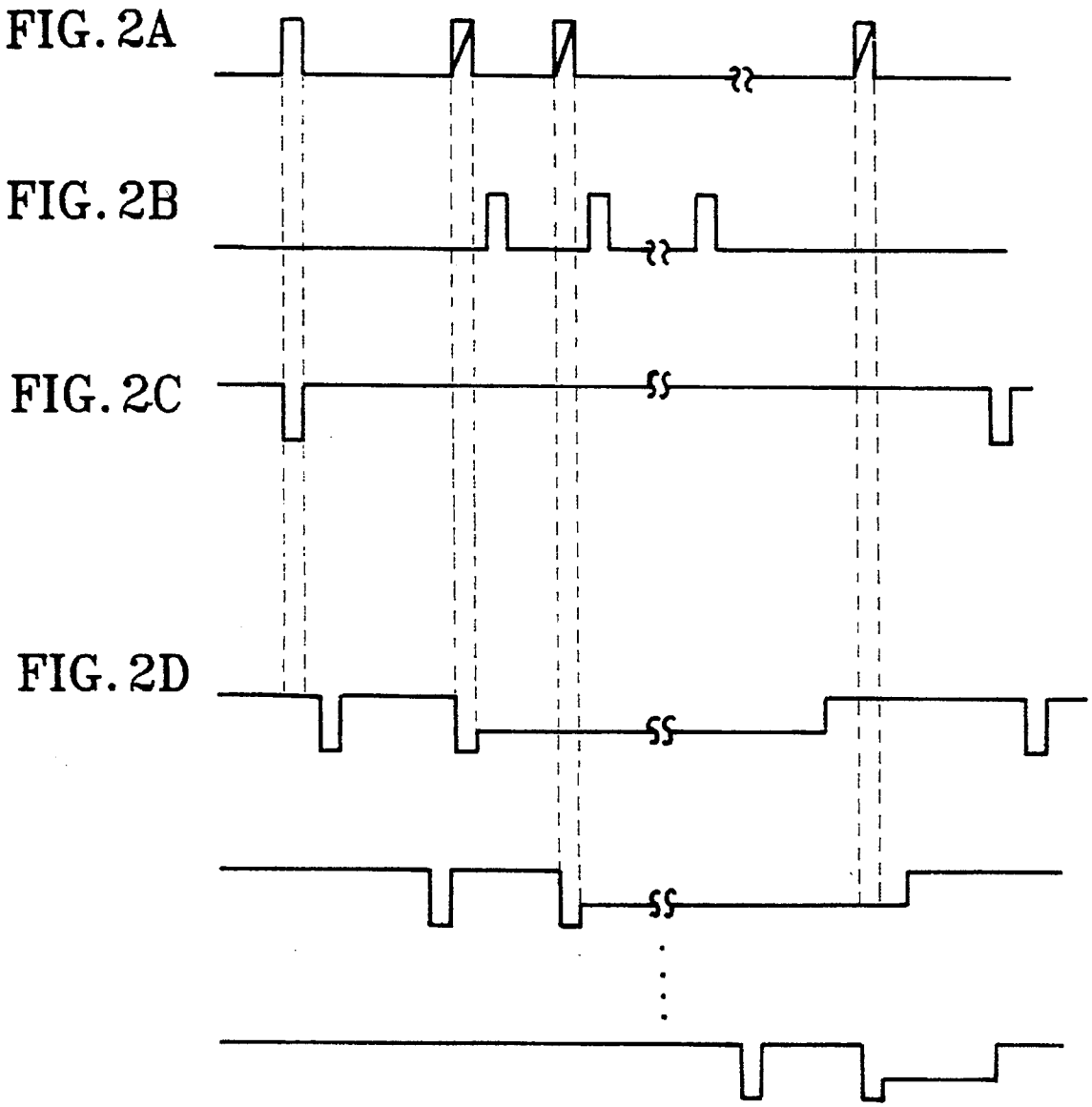
FIGS. 2A–2D show waveforms of pulses applied with each electrode and for driving the conventional direct current memory type PDP.
Figures 3A, 3B, 3C, 3D:
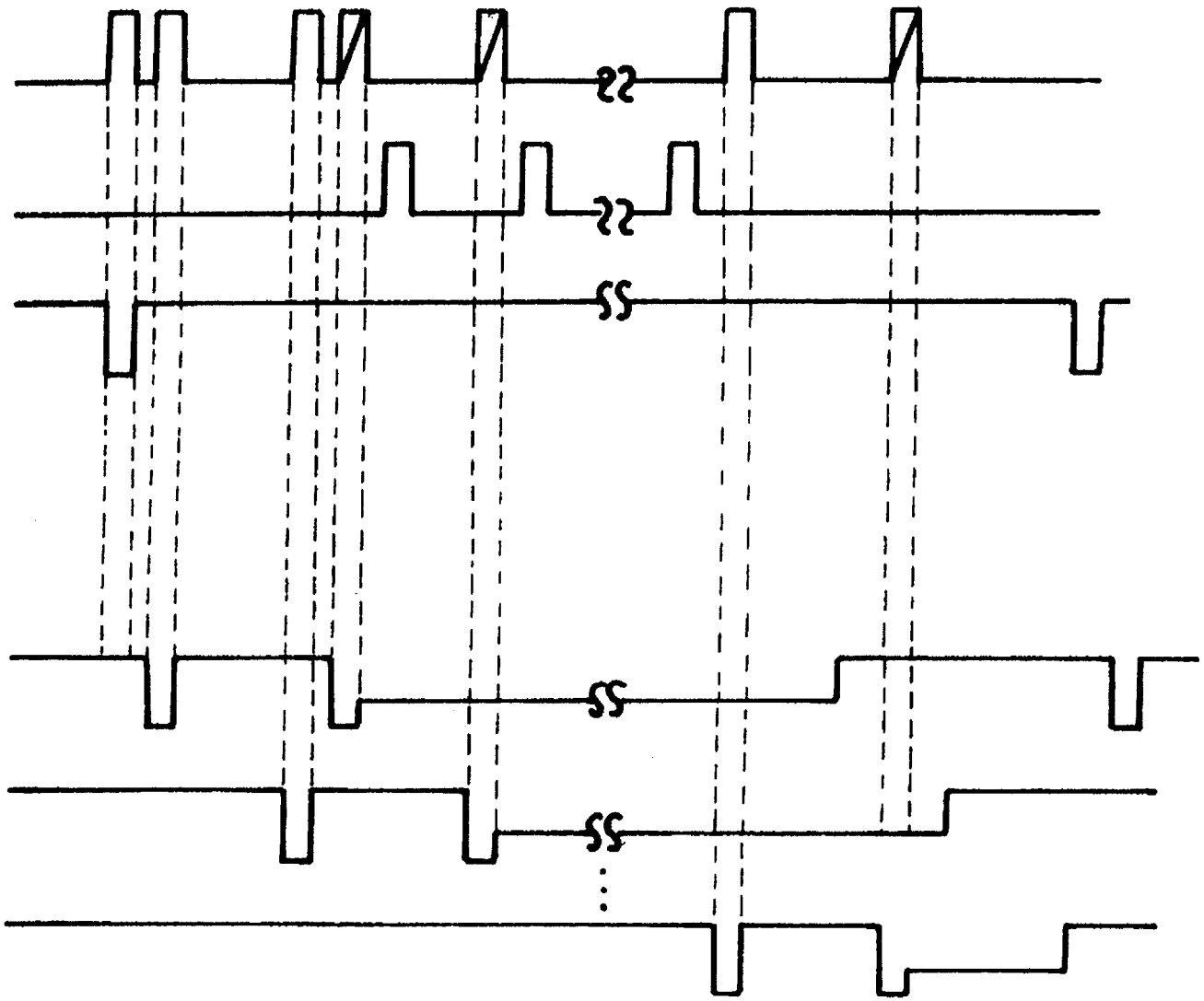
FIGS. 3A–3D show waveforms of pulses applied with each electrode and for driving the direct current memory type PDP according to the present invention.

FIG. 3A shows a pulse applied on the anode, FIG. 3B shows a pulse applied to the sustaining anode, FIG. 3C shows a pulse applied to the trigger electrode, and FIG. 3D shows a pulse applied to the cathode.

Figure 4:
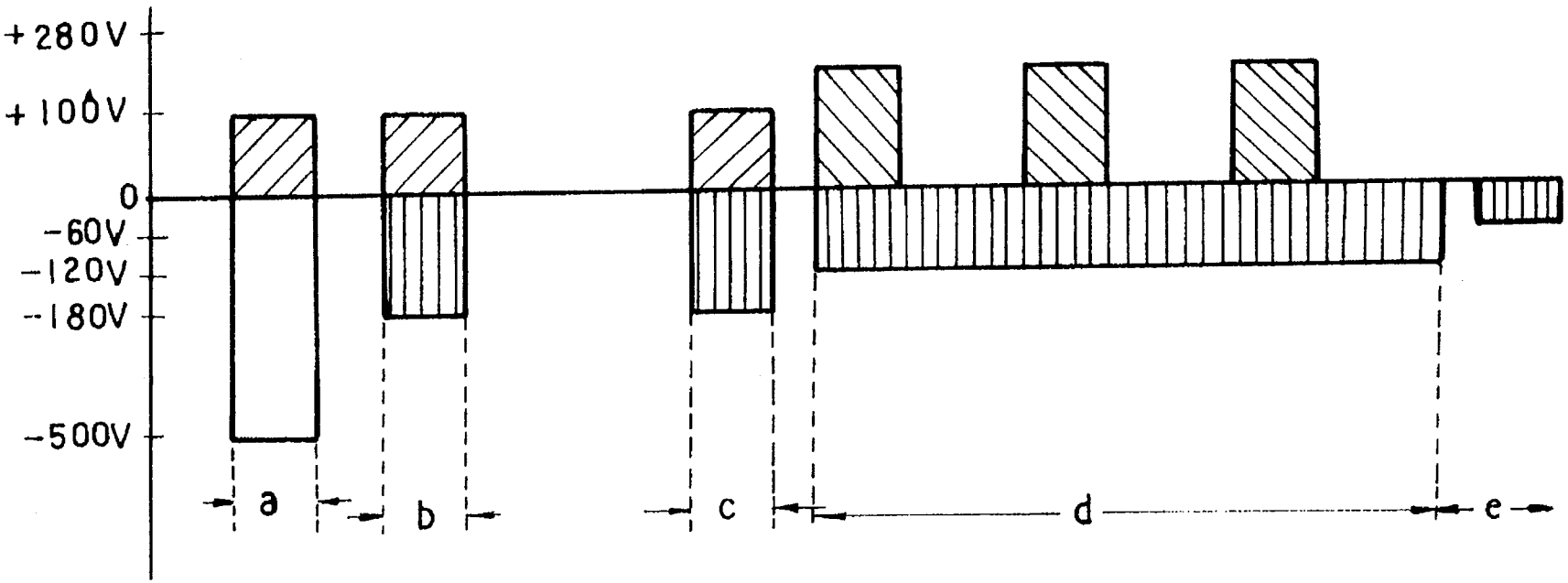
FIG. 4 is a voltage level diagram showing the pulses applied at each part of the direct current memory type PDP according to an embodiment of the present invention.

FIG. 4 shows a voltage level of the pulse applied to each portion of the plasma display panel of the present invention. Now, a driving method of the plasma display panel of the present invention will be described with reference to FIG. 4.

The first step (whose interval is denoted as "a") is to perform a trigger setting. At this moment, if a trigger turns on, i.e., the trigger electrode is loaded with about −500 V and the data is about 100 V, a discharge occurs between the trigger electrode and the anode, so that positive charges can accumulate on the dielectric material.

The second step (whose interval is denoted as "b") is to perform a trigger discharge. When the first cathode is initially turned on, i.e., about −180 V is applied thereto, the data of approximately 100 V is applied, so that a discharge is carried out and, simultaneously, the positive charges accumulated on the dielectric material around the first cathode begin to discharge. Therefore, a sufficient trigger discharge can be thus performed and nearly almost all of the positive charges slacked on the dielectric material are removed.

The third step (whose interval is denoted as "c") is to perform a primary discharge. As time elapses and the first cathode turns on a second time, i.e., approximately −180 V is applied to the first cathode, and the discharge does not occur when no data is present. However, when data is present, the primary discharge occurs by the application of about 100 V to the anode. In other words, enough trigger discharge facilitates the primary discharge. Also, with no data being applied, since the positive charges stacked on the dielectric material around the first cathode are completely removed, discharge will not occur inadvertently.

The fourth step (whose interval is denoted as "d") is to perform a sustaining discharge operation. After the completion of the primary discharge, a voltage of about 140 V is applied to the sustaining anode, so that the medium level voltage of the first cathode becomes about −120 V to further maintain the discharge. The primary discharge lowers the subsequent discharge voltage, so that the discharge can be maintained with a low sustaining voltage. If no data exists in the primary discharging step, the primary discharge cannot take place. Further, no primary discharge makes it difficult to lower the subsequent discharge voltage, so that the sustaining discharge can not occur.

The fifth step (whose interval is denoted as "e") is to finish sustaining discharge. If the first cathode has the maximum voltage level (approximately −60 V), the difference between the voltages at sustaining anode and first cathode remains at approximately 200 V, which thereby finishes the sustaining discharge operation.

As suggested by a characteristic of the conventional memory-type plasma display panels, the scan speed is high during the frame period, the sustaining discharge can be performed during the remaining period, to enhance luminance. Moreover, if a sustaining discharge operation is performed by properly partitioning one frame period, gray scale can be enhanced.

Accordingly, the driving method of the plasma display panel according to the present invention provides certain advantages: (1) The data voltage is applied during the trigger discharging, so that sufficient trigger discharging can be performed and therefore subsequent primary discharges are facilitated, and (2) a sufficient trigger discharging completely removes the positive charges accumulated on the dielectric material around the cathode, so that during the primary discharging, even if no data is supplied, inadvertent discharging can be prevented between the accumulated positive charges and the cathode, and the subsequent sustaining discharges can be prevented.

What is claimed is:

1. A method of driving a plasma display panel having a plurality of discharge cells, each discharge cell including an anode, a sustaining anode, a triggering electrode, and a cathode arranged in a matrix, said method comprising:

a trigger setting step of setting a trigger by generating a voltage difference between a first trigger pulse signal applied to said triggering electrode and a data pulse signal applied to said anode, to produce a positive charge on a dielectric material layer disposed on said triggering electrode;

a trigger discharging step of generating a trigger discharge by applying a second trigger discharge pulse to said cathode and a second data pulse signal to said anode to discharge the positive charge on said dielectric material layer proximate said cathode;

a primary discharging step of generating a primary discharge whenever data is present by applying a third data pulse to said anode and a primary discharging pulse to said cathode after the completion of said trigger discharging step, and of generating a primary discharge when data is not present;

a discharge sustaining step of sustaining the primary discharge by applying a voltage sustaining pulse to said sustaining anode and a sustaining voltage to said cathode, after said primary discharging step; and a discharge extinguishing step of extinguishing the primary discharge upon completion of said discharge sustaining step by reducing a voltage difference between the voltage sustaining pulses applied to said anode and to said cathode.

2. The method of driving a plasma display panel as claimed in claim 1 wherein the trigger setting step includes generating a voltage differential between said triggering electrode and said anode that is greater than a voltage differential generated in the trigger discharging step between said anode and said cathode.

3. The method of driving a plasma display panel as claimed in claim 2 wherein the trigger discharging step includes generating a voltage differential between said cathode and said anode that is greater than a voltage differential generated in the primary discharging step between said cathode and said anode when no data is present.

4. The method of driving a plasma display panel as claimed in claim 3 wherein the discharge sustaining step includes generating a voltage differential between said cathode and said sustaining anode that is less than the voltage differential generated in the primary discharging step between said anode and said cathode.

5. A method for driving a plasma display panel comprising:

producing a positive charge on a dielectric material disposed on a trigger electrode by applying a first pulse signal to said trigger electrode and a second pulse signal to an anode;

triggering a discharge of the positive charge on said dielectric material by applying a third pulse signal to said anode and a fourth pulse signal to a cathode;

generating a primary discharge whenever data is present by applying a data signal to said anode and a fifth pulse signal to said cathode;

sustaining the primary discharge by applying a voltage sustaining pulse to said anode and a voltage signal to said cathode; and extinguishing the primary discharge by reducing a voltage difference between the data signal and the fifth pulse signal below a sustaining voltage.

6. The method of claim 5 wherein triggering a discharge includes controlling a voltage difference between the third pulse signal and the fourth pulse signal to have a smaller magnitude than a voltage difference between the first and second pulse signals.

7. The method of claim 6 wherein generating the primary discharge includes controlling a voltage difference between the data signal and the fifth pulse signal to have a smaller magnitude than the voltage difference between the first and second pulse signals.

8. The method of claim 7 wherein sustaining the primary discharge includes controlling a voltage difference between the voltage sustaining pulse and the voltage signal to have a smaller magnitude than the voltage difference between the data signal and the fifth pulse signal.

* * * * *